US010551087B2

(12) United States Patent
Neidenberger et al.

(10) Patent No.: US 10,551,087 B2
(45) Date of Patent: Feb. 4, 2020

(54) HEAT EXCHANGER WITH AN INTERNAL CONDUIT FOR CONDUCTING A FLUID

(71) Applicant: WEBASTO SE, Stockdorf (DE)

(72) Inventors: Peter Neidenberger, Olching (DE); Tobias Pfannenstiel, Augsburg (DE); Björn Smigiel, Seefeld (DE); Achim Holzwarth, Feldkirchen (DE); Florian Larisch, Zankenhausen (DE)

(73) Assignee: Webasto SE, Stockdorf (DE)

( * ) Notice: Subject to any disclaimer, the term of this patent is extended or adjusted under 35 U.S.C. 154(b) by 398 days.

(21) Appl. No.: 15/101,478

(22) PCT Filed: Dec. 5, 2014

(86) PCT No.: PCT/EP2014/076723
§ 371 (c)(1),
(2) Date: Jun. 3, 2016

(87) PCT Pub. No.: WO2015/082685
PCT Pub. Date: Jun. 11, 2015

(65) Prior Publication Data

US 2016/0305687 A1 Oct. 20, 2016

(30) Foreign Application Priority Data

Dec. 6, 2013 (DE) ..... 10 2013 020 469

(51) Int. Cl.
*F24H 1/14* (2006.01)

(52) U.S. Cl.
CPC ..... *F24H 1/145* (2013.01)

(58) Field of Classification Search
CPC ..... F24H 1/145; F28D 7/12; F28D 21/0005; F28F 1/40; F28F 2255/14; F28F 2255/16; F28F 2275/06
See application file for complete search history.

(56) References Cited

U.S. PATENT DOCUMENTS 1,961,907 A * 6/1934 Mott ..... F28D 7/12 165/140
2,359,816 A * 10/1944 Wolf ..... F24H 1/145 122/367.3

(Continued)

FOREIGN PATENT DOCUMENTS

CN 2406212 Y 11/2000
DE 3338642 C1 6/1984

(Continued)

OTHER PUBLICATIONS

PCT International Search Report, PCT/EP2014/076723, dated Feb. 10, 2015.

*Primary Examiner* — Ljiljana V. Ciric
(74) *Attorney, Agent, or Firm* — Quarles & Brady LLP

(57) ABSTRACT

A heat exchanger and a method of manufacturing a heat exchanger having an internal conduit for conducting a fluid, and a heat dissipating body for dissipating heat of the fluid. The heat dissipating body has a cavity extending in a longitudinal direction. An end piece of the internal conduit extends inside of the cavity and has an orifice facing a bottom surface of the cavity for feeding the fluid into a bottom area of the cavity. An inner shell of the heat dissipating body includes a first portion and a second portion, each portion having at least two ribs transversally displaced in relation to each other. At least one rib of one of the first and the second portion is transversally displaced in relation to each rib of the other of the first and the second portion.

10 Claims, 11 Drawing Sheets

(56) References Cited

U.S. PATENT DOCUMENTS 2,864,404 A * 12/1958 Bruegger ..... F22B 1/066 138/38
3,887,004 A 6/1975 Beck
4,624,218 A * 11/1986 Bauml ..... B60H 1/2209 122/136 C
6,321,792 B1 * 11/2001 Von Huth Smith ... F02M 31/20 138/106
8,511,074 B2 * 8/2013 Kuehnel ..... F28F 13/08 165/164
2002/0014328 A1 * 2/2002 Mitrovic ..... F28F 1/40 165/183
2002/0046830 A1 * 4/2002 Ulrich ..... B60H 1/00342 165/183
2003/0070793 A1 * 4/2003 Dierbeck ..... F28D 9/0081 165/145
2005/0039885 A1 * 2/2005 Vaidyanathan ..... F28F 7/02 165/80.4
2005/0235973 A1 * 10/2005 Husges ..... F28D 9/0031 123/568.12
2007/0235438 A1 * 10/2007 Boussier ..... F24D 3/165 219/407
2009/0260586 A1 * 10/2009 Geskes ..... F02B 29/0462 123/41.48
2010/0242863 A1 * 9/2010 Hubau ..... B22D 19/0063 122/367.1
2013/0276448 A1 * 10/2013 Weigold ..... F22G 7/14 60/648
2014/0110085 A1 * 4/2014 Deckers ..... F24H 9/0015 165/80.1
2014/0261241 A1 * 9/2014 Deckers ..... F24H 1/32 122/18.31
2016/0023535 A1 * 1/2016 Alber ..... F24H 9/148 60/320
2017/0328651 A1 * 11/2017 Rozga ..... F28F 1/12

FOREIGN PATENT DOCUMENTS

DE 3416878 A1 11/1985
DE 3418921 A1 11/1985
DE 29707104 U1 6/1997
DE 10306483 A1 8/2004
DE 102005029321 A1 12/2006
DE 102005051709 A1 5/2007
DE 102007017106 A1 10/2008
ES 2120334 A1 10/1998
FR 575978 A 8/1924
FR 2617579 A1 1/1989
JP S58219301 A 12/1983
JP H1172104 A 3/1999
JP 2004136287 A 5/2004
JP 2007003115 A 1/2007
JP 2012519577 A 8/2012
SU 851087 A1 7/1981

* cited by examiner

HEAT EXCHANGER WITH AN INTERNAL CONDUIT FOR CONDUCTING A FLUID

CROSS-REFERENCE TO RELATED APPLICATIONS

This application represents the national stage entry of PCT International Application No. PCT/EP2014/076723 filed Dec. 5, 2014, which claims priority of German Patent Application 10 2013 020 469.0 filed Dec. 6, 2013, the contents of which are hereby incorporated herein by reference for all purposes.

BACKGROUND

The invention relates to a heat exchanger having an internal conduct for conducting a fluid, and having a heat dissipating body for dissipating heat of the fluid, wherein the heat dissipating body having a cavity extending in a longitudinal direction, at least one end piece of the internal conduct extending inside of the cavity, the end piece having an orifice facing a bottom surface of the cavity for feeding the fluid into a bottom area of the cavity, wherein between an outer shell of the internal conduct and an inner shell of the heat dissipating body a streaming space for conducting the fluid away from the bottom area is provided.

The invention further relates to a method of manufacturing a heat exchanger.

SUMMARY

In a first example of use, a heat exchanger is employed in an exhaust gas system of a motor vehicle in order to dissipate a maximum portion of the heat generated by the motor of the motor vehicle, for example, by conveying the heat into a heat transporting fluid.

Thereby, a potential overheating of the exhaust gas system can be avoided. Moreover, the heat extracted from the exhaust gas can be used for heating purposes, for example, for heating a passenger compartment of the motor vehicle. According to a second example of use, the heat exchanger is part of a heating device or is connected to a heating device, for example, in a vehicle.

The possible applications of the heat exchanger described herein are not restricted to the vehicle sector. Rather, the heat exchanger can be principally used for each application in which heat shall be extracted from or conveyed to a fluid, i.e. a liquid or gaseous medium.

It is an object of the invention to provide a heat exchanger that has a structure as simple as possible and, accordingly, is easy to manufacture, and which has further a high efficiency, i.e. a heat exchange rate as high as possible. This object is solved by the characterizing feature of claim 1.

A further object of the invention is to provide a method of manufacturing of such a heat exchanger, the complexity of such method being as low as possible. This object is solved with the features of claim 12.

The heat exchanger according to the present invention is based on prior art in that the inner shell of the heat dissipating body comprises a first and a second portion, the first portion having two ribs that are transversally displaced in relation to each other, and the second portion having two ribs that are transversally displaced in relation to each other and wherein at least one rib of the second portion is transversally displaced in relation to each rib of the first portion, or at least one rib of the second portion is transversally displaced in relation to each rib of the first portion.

Preferably, at least two, three, four, five or six ribs of the first or the second portion are transversally displaced in relation to each rib of the second or the first portion. An embodiment is considered as being optimal, in which each rib of the first portion is transversally displaced in relation to each rib of the second portion. A rib of a heat exchanger is an element located in the streaming area of the heat exchanger, the element increasing the efficient surface of the heat exchanger and thereby the efficiency of the heat exchanger. Each portion can, for example, be undulated or corrugated. In this case, each peak of the undulation or each peak of the corrugation forms a rib. The ribs of any portion can extend parallel to each other and can be equally spaced. This can favor a fluid streaming through the cavity being as uniform as possible. The ribs can be elongate. For example, the length of reach rib can be more than threefold or even more than tenfold of the maximum dimension of the rib that is positioned transversally in relation to the streaming path. A direction transvers in relation to the longitudinal direction is also referred to as transversal direction. As mentioned, the ribs of both portions are transversally displaced relative to each other. Therefore, the inner shell of the heat dissipating body has a discontinuity at the border between the two portions. This promotes the appearance of turbulences at the border between the portions and therefore promotes a mixing of fractions of the fluid that are close to the surface with fractions of the fluid that are far away from the fluid, at the transition between the first portion and the second portion. The efficiency of the heat exchanger is thereby improved as compared to a heat exchanger that has an always continuous inner shell. It can be advantageous to have more than two adjacent portions of this kind. Each rib of the first portion can have a face surfaces facing the second portion. Each rib of the second portion can have a face surfaces facing the first portion. Preferably, a rib of the first portion (first rib) is deemed to be transversally displaced in relation to each rib of the second portion (second rib) if and only if the projection of the face surface of the first rib on a transversal surface (first projection) and the projection of a face surface of the second rib on the same transversal surface (second projection) are displaced to each other in a sense that none of the both projections completely covers the other one. In more simple words, this means that none of the both mentioned face surfaces is projected completely on the other one; therefore, the face surface of the first rib does not project or projects only partly on the face surface of the second rib and the face surface of the second rib does not project or projects only partly on the face surface of the second rib. A transversal surface is a surface perpendicular to the longitudinal direction, i.e. a surface having a normal vector that is parallel to the longitudinal direction. A projection is meant as an orthogonal projection. For instance it can be provided that the first projection covers less than 70 percent, less than 20 percent or even less than 10 percent of the surface of the second projection. Alternatively or additionally it can be provided that the second projection covers less than 70 percent, less than 20 percent or even less than 10 percent of the surface of the first projection. In particular it can be provided that both projections do not overlap. Overlapping of the both projections that is as small as possible is considered as advantageous in regard to the generation of turbulences.

The heat dissipating body may comprise a cast or extruded first segment comprising the first portion as well as a cast or extruded second segment comprising the second portion. Therefore, the heat dissipating body can be manufactured easily by first manufacturing the first segment and separately manufacturing the second segment, whereupon the segments are assembled. The above-mentioned abrupt transition from the first portion to the second portion may therefore be realized in a non-complex manner. Both of the single segments can, for example, be manufactured by machines that are already designed or already existing.

The first segment and the second segment may be identically constructed. In this case there is no need to manufacture different segments resulting in a particularly cost efficient manufacturing method. The heat dissipating body can have more than two segments that are identically constructed.

The first and the second portion can be arranged such that each rib of the first portion extends to a channel that is located between two adjacent ribs of the second portion. Thus, in this case, each rib of the first portion merges in a channel of the second portion. Turbulences may appear in the fluid at the transition from the rib to the channel. It may be provided that the rib completely or partially covers the channel to which it extends. This means that a face surface of the rib facing the channel and a transversal cross section of the channel are overlapping completely or in part at the beginning or the end of the channel that meets the rib. For example, it can be provided that the rib covers the cross section of the channel to which it extends by more than 20 percent, more than 50 percent, more than 80 percent or even by 100 percent.

Moreover, between two adjacent ribs of the first portion a channel can be located that extends to a rib of the second portion. Therefore, the channel that is formed between the adjacent ribs of the first portion merges into a rib of the second portion at the border between both portions. The abrupt transition from the channel to the rib promotes the mixing of the fluid. It can be provided that the rib covers the channel to which it extends, completely or partly. Thus, a face surface of the rib facing the channel and a transversal cross section of the channel at its beginning or end meeting the rib are overlapping completely or in part. For example, it can be provided that the rib covers the cross section of the channel to which it extends by more than 20 percent, more than 50 percent, more than 80 percent or even by 100 percent.

The heat dissipating body or at least its inner shell may comprise a rotational symmetry axis. This means that the heat dissipating body or at least its inner shell are transferred into themselves if a hypothetical rotation around the rotation symmetry axis is performed, i.e., they are invariant under the corresponding rotation. Such a symmetry may provide a high efficiency and may also facilitate the manufacturing of the heat dissipating body.

For example, the first and the second portions may comprise N ribs each, wherein the position of the $i^{th}$ rib of the first portion comprises an azimuthal angle of 3060/N*i wherein i=0, . . . , N−1, and wherein a constant $\alpha$ is existing in interval (0; ½], such that the position of each $j^{th}$ rib of the second portion comprises an azimuthal angle of 360°/N*(j+$\alpha$), wherein j=0, . . . , N−1. Preferably, the constant $\alpha$ is in the interval [1/10; ½], i.e. $0.1=<\alpha=<0.5$. In the case $\alpha$=½ the inner shell or even the whole of the heat dissipating body may be symmetric under respective rotation of 180°/N about the rotational symmetry axis. Thus, if M segments are provided in total, it may be advantageous that the position of the $j^{th}$ rib of the $k^{th}$ portion (20') comprises an azimuthal angle of 360°/N*(j+k/M), wherein j=0, . . . , N−1 and k=0, . . . , M−1. In this case a symmetry under rotation of 360°/(N*M) about the rotation symmetry axis may be present.

The ribs of the first portion and the ribs of the second portion can each be elongate and extend in the longitudinal direction. In particular, the ribs can be each arranged parallel to the longitudinal direction. Such a rib structure may be particularly simple in manufacturing. For example, each of the ribs may have a substantially constant transversal cross section. This means that the transversal cross section of the rib is substantially constant at least on a portion along the longitudinal direction. This portion is referred to as "rib portion having constant cross section". The length of the rib portion having constant cross section can be, for example, more than 50 percent, more than 80 percent or even more than 90 percent of the length of the rib. The term "length" in this disclosure is always meant as a dimension in the longitudinal direction, if not anything else can be conducted from the particular context. A transversal cross section is a cross section that is perpendicular to the longitudinal direction. The transversal cross section of the rib can, for example, be essentially constant, in a sense that on the rib portion having constant cross section all changes of the transversal cross section are small in relation to the dimension of the cross section, for example, as compared to the width and/or height of the cross section. In other words, it may be provided that the rib portion having constant cross section has the appearance of a finite part of a geometric body that is invariant under infinitesimal translations in the longitudinal direction. A set of geometrical points invariant under infinitesimal translations if an infinitesimal translation transforms each point into another point of the same set. For example, the rib portion having constant cross section or even the whole rib may have the appearance of a cylinder. The cross section of the cylinder may have any shape, for example, substantially the shape of a rectangle.

Further, it may advantageous that in the longitudinal direction the ribs of the first portion and the ribs of the second portion each extend over the whole of the subject portion. Such a heat dissipating body may be relatively easy to manufacture.

The internal conduct may comprise a combustion chamber or may communicate with a combustion chamber. Part of the heat that is generated by the combustion can therefore be dissipated by the heat dissipating body and provided to a destination, for example, to a passenger compartment of a motor vehicle.

It may further be provided that the inner shell of the heat dissipating body comprises a third portion adjacent to the second portion, the third portion having at least two ribs that are transversally displaced to each other, wherein at least one rib of the third portion is transversally displaced in relation to each rib of the second portion, or wherein at least one rib of the second portion is transversally displaced in relation to each rib of the third portion. Transversally means, as explained above, "transvers in relation to the longitudinal direction". Thereby, a further zone of turbulences is generated, namely at the border between the second and the third portions. Further, it is possible that the inner shell of the heat dissipating body comprises further portions having the features that have been described referring to the first and the second portions.

The heat dissipating body may particularly be manufactured by a method that comprises the following steps: manufacturing a first segment comprising the first portion; manufacturing a second segment comprising the second portion; and assembling the first segment and the second segment. This method may be particularly uncomplicated when performed, since the inner shells of both of the single segments have a simpler structure than the assembled inner shell. In an alternate method, the heat dissipating body is manufactured in one piece, for example, using a salt core method.

The first and the second segments may, for example, be manufactured separately by casting or extruding. Alternatively, the segments can also be assembled from single elements, for example, by welding.

If both of the segments are identically constructed, they may be manufactured in sequence using a common manufacturing device. If a casting method is chosen they may be cast in sequence in the same mold. Therefore, the mold can be used twice.

The first segment and the second segment may, for example, be assembled by welding. This provides an adhesive bond or metallic continuity. Thereby, a sealing of the cavity at the contact point may be simultaneously provided. Alternatively, a connection of both of the segments by mechanical connection elements may be considered, for example, rivets or screws. In this case it may be required to seal the connecting point between both of the segments by using sealing means.

In the following, the invention will be further explained, referring to the attached drawings and corresponding embodiments.

Figure 1:
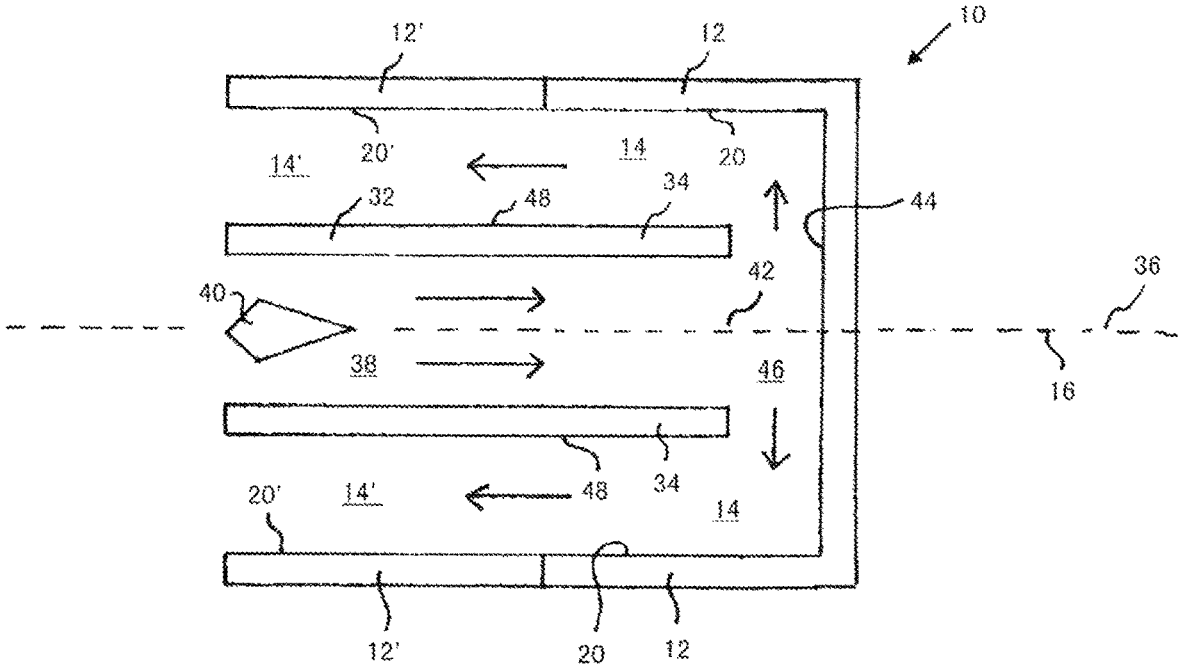
FIG. 1 shows a schematical cross section of an exemplary heat exchanger

In the present disclosure a top view is a presentation in which the longitudinal direction is perpendicular with respect to the drawing surface, if nothing else results from the context.

DETAILED DESCRIPTION

In the following description of the drawings identical reference numbers refer to identical or similar components.

FIG. 1 schematically shows an example of a heat exchanger 10 having an internal conduct 32 for conducting a fluid and having a heat dissipating body 12, 12' for dissipating heat of the fluid. The internal conduct 32 can be a hollow conduct, for example, a pipe. It can basically have any cross section, for example, a circular or quadratic cross section. In the example as shown the internal space 38 is a combustion chamber for the internal conduct 32. The internal conduct 32 may therefore referred to as fire tube. During operation a combustible material (not shown) is combusted in the combustion area 40. Thereby, hot exhaust gas is generated. The internal conduct 32 comprises an orifice 42 through which the hot exhaust gas exits from the internal conduct 32.

The heat dissipating body 12, 12' comprises a cavity 14, 14' extending in a longitudinal direction 36. The heat dissipating body 12, 12' and/or the internal conduct 32 may have a rotational symmetry axis 16. In this case, the longitudinal direction 36 is parallel with respect to the rotational symmetry axis 16. Within the cavity 14, 14' at least one end portion of the internal conduct 32 extends, referred to as end piece 34. The end piece 34 comprises the orifice 42. The orifice 42 faces a bottom surface 44 of the cavity 14, 14'. In operation, a fluid, in this example hot exhaust gas, flows out of the internal conduct 32 over the orifice 42 into a bottom area 46 of the cavity 14, 14' (in the drawing, the flow is indicated by arrows).

Between an outer shell 48 of the internal conduct 32 and an inner shell 20, 20' of the heat dissipating body 12, 12', a flow space for conducting the fluid away from the bottom area 46 is designed. The flow space extends in the longitudinal direction 36. The inner shell 20, 20' of the heat dissipating body 12, 12' comprises a first portion 20 and a second portion 20' adjacent to the first portion 20. According to an alternative (not shown) of the embodiment as shown, the heat dissipating body 12, 12' comprises a lateral exit for letting out the fluid.

The first portion 20 comprises at least two ribs 22 (see FIGS. 2 to 9) that are transversally displaced in relation to each other. Transversal means perpendicular with respect to the longitudinal direction 36. The second portion 20' comprises at least two ribs 22' that are transversally displaced in relation to each other. Moreover, each rib 22' of the second portion 20' is transversally displaced in relation to each rib 22 of the first portion.

In the example (see FIG. 1) the heat dissipating body 12, 12' comprises a first segment 12 and a contiguous second segment 12'. The first segment 12 may be cup shaped. The second segment 12' may be ring shaped. In the example the cup shaped first segment has a bottom portion, the inner surface of which forms the bottom surface 44 of the cavity. The first portion 20 of the inner shell 20, 20' of the heat dissipating body and a first portion 14 of the cavity 14, 14' are assigned to the first segment 12. The second portion 20' of the inner shell 20, 20' of the heat dissipating body and a first portion 14 of the cavity 14, 14' are assigned to the second segment 12'.

Figure 2:
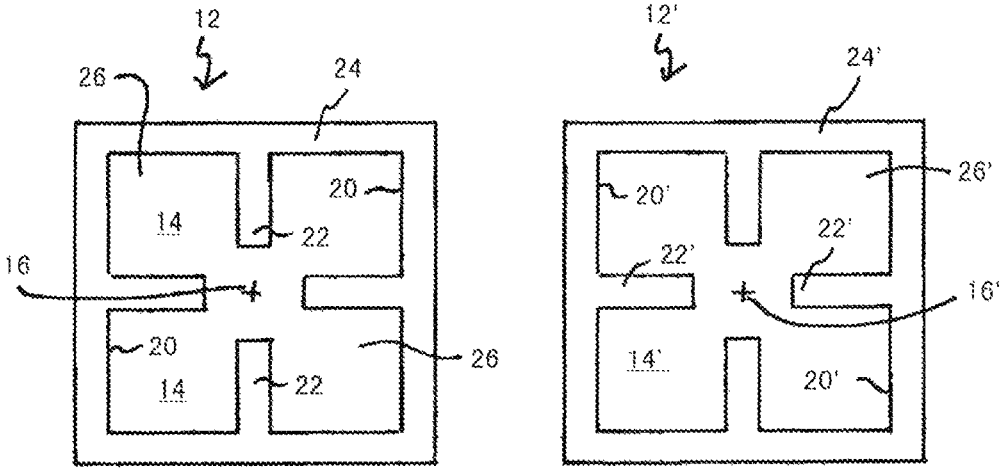
FIG. 2 shows a schematical top view of a first and a second segment of a cavity of the heat exchanger.

FIG. 2 schematically shows a first segment 12 and a second segment 12' of a heat dissipating body. In the example as shown, both segments 12 and 12' are identically constructed. In order to avoid repetitions, only the first segment 12 is described now. The segment 12 essentially comprises a ring shaped or pipe shaped segment body 24 through which a cavity 14 is passing. In the example as shown, the segment body 24 has a quadratic outline, however different shapes are possible. According to a preferred embodiment (not shown), the outline of the segment body 24 is circular. At least two ribs 22, in the example as shown exactly four, protrude from the segment body 24 into the cavity 14. The segment body 24 and the ribs 22 can be designed in one piece. The segment body 24 and the ribs 22 are preferably manufactured from a material having a high heat conductivity, for example, from a metal or from an alloy. The segment 12 comprises an inner shell 20 defining the cavity 14, the shell 20 forming the mentioned first portion in the heat exchanger. The four ribs 22 each are displaced relative to each other by 90° in relation to a rotational symmetry axis 16. Therefore, the example of a segment 12 as shown here is symmetrical under rotation of 90° about the rotational symmetry axis 16. In operation of the heat exchanger, the fluid, for example, hot exhaust gas, flows through the cavity 14 in a main flow direction, being parallel to the rotational symmetry axis 16 in the example as shown. In the example as shown, each of the ribs 22 extends along the longitudinal direction, i.e. parallel to the symmetry axis 16, over the whole of the inner shell from the entrance area to the exit area of the segment body 24. In another example (not shown) one or more ribs are shorter than the respective portion, i.e. they do not extend over the whole of the portion. According to an alternative of these examples, the ribs 22' that extend in transversal direction (here in radial direction) are shorter than the ribs 22.

Figure 3:
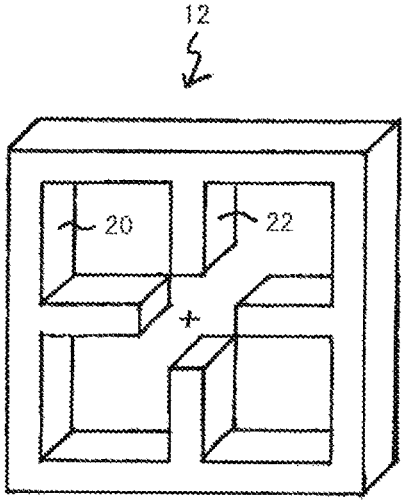
FIG. 3 shows a shortened schematical inclined view of the first segment.

FIG. 3 shows a schematical inclined view of the segment 12 in which for clarity reasons the segment 12 is shown in a shortened manner. According to a preferred embodiment, the ribs are elongated along the longitudinal direction (see the unshortened presentation in FIG. 4). This makes it possible to generate a comparably long heat exchanging path using a comparably small number of segments.

Figure 4:
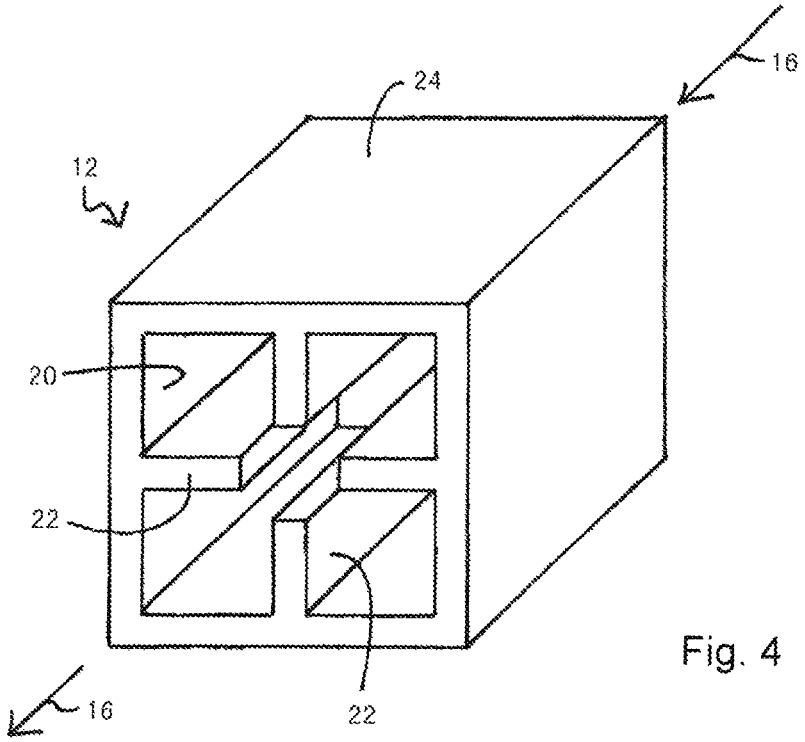
FIG. 4 shows an unshortened schematical inclined view of the first segment.
Figure 5:
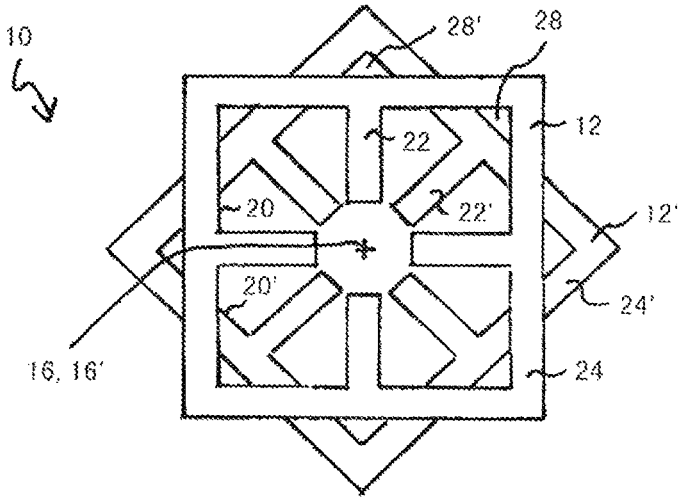
FIG. 5 shows a schematical top view of the heat dissipating body of the heat exchanger.
Figure 6:
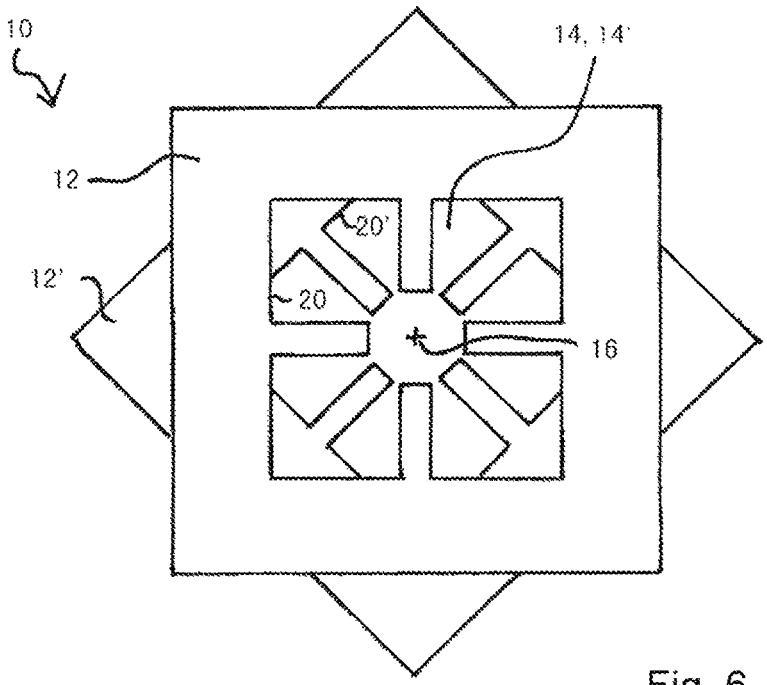
FIG. 6 shows a schematical top view of the heat dissipating body of the heat exchanger according to a further embodiment.

FIG. 5 schematically shows two segments 12 and 12' (compare FIG. 2) of a heat dissipating body of a heat exchanger 10. The heat dissipating body in addition has a bottom segment (not shown) that corresponds to the segment 12 in FIG. 1. The heat dissipating body 12, 12' serves for transferring heat from the fluid to the heat dissipating body 12, 12' or from the heat dissipating body 12, 12' to the fluid. The heat dissipating body 12, 12' comprises a cavity 14, 14' that is assembled from the cavities 14 and 14' and through which fluid can flow along a longitudinal direction. In FIG. 4 the flow path is perpendicular to the drawing surface. The inner shell 20 of the first segment 12 forms a first section of the inner surface 20, 20' of the heat dissipating body 12, 12'. The inner surface 20' of the second segment 12' forms a second portion of the inner shell of the heat dissipating body 12, 12' adjacent to the first portion 20. The first portion 20 therefore comprises at least two ribs 22 in the example as shown, exactly four ribs 22. Also, the second portion 20' comprises at least two ribs 22', in the example as shown, exactly four ribs 22'.

As can be gathered from FIG. 5, the ribs 22 and 22' of the first segment 12 and the second segment 12', respectively, are transversally displaced to each other, i.e. transversal in relation to the main flow direction. In the example as shown, this is achieved by an arrangement in which the second segment 12' is rotated by 45° about the common rotational symmetry axis 16, 16' in relation to the first segment 12. More exactly, each rib 22' of the second portion 20' is transversally displaced in relation to each rib 22 of the first portion. The part of the cavity 14 that is situated between two adjacent ribs 22 is also referred to as channel 26 in this disclosure (see FIG. 2). The same applies in analogy with respect to the second segment 12'. The segments 12 and 12' therefore each comprise two channels 26 and 26', respectively. In the example as shown there are exactly four channels 26 and 26', per segment. The displacement of the ribs 22 in relation to the ribs 22' as described with reference to FIG. 5 results into the fact that each channel 26 meets a rib 22' at the border between the two segments 12 and 12', while each rib 22 meets a channel 26'. This arrangement promotes a mixing within the fluid that flows through the heat dissipating body 12, 12'.

In the geometry shown in FIG. 5, an additional sealing between the segments 12 and 12' may be required in the regions 28 and 28' that are not closed. Advantageously, these segments 12 and 12' are designed such that in between no potential leaks occur (compare FIG. 6).

Figure 7:
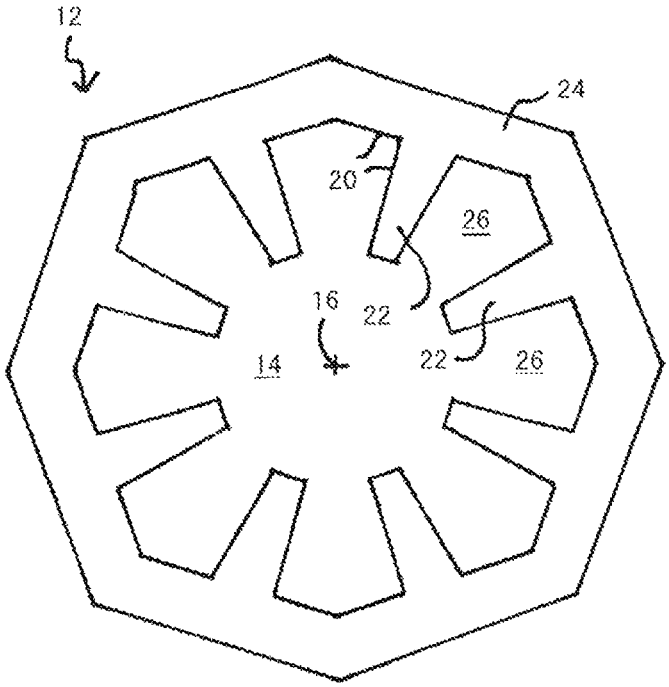
FIG. 7 shows a schematical top view of a segment according to a further embodiment.

FIG. 7 schematically shows an example of a segment 12 having exactly eight ribs 22 and an octagonal profile. In further examples (not shown), the segment 12 has more than eight ribs.

Figure 8:
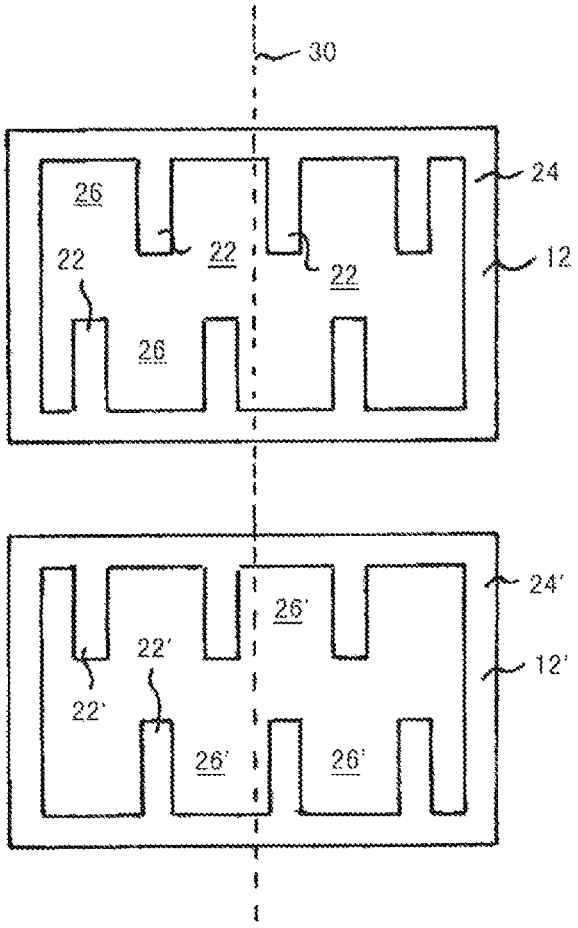
FIG. 8 shows a schematical top view of two segments according to a further embodiment.
Figure 9:
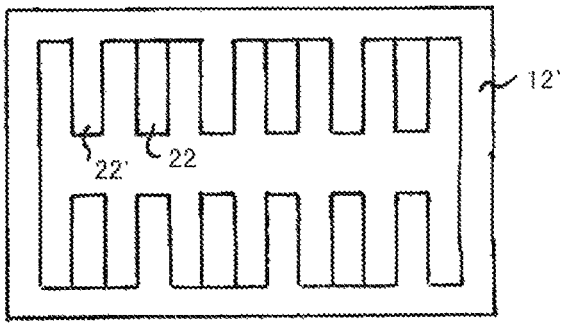
FIG. 9 shows a schematical top view of a heat dissipating body of a heat exchanger having the segments from FIG. 7.

FIG. 8 and FIG. 9 show an example of an embodiment in which the heat dissipating body comprises a first and an identically constructed second segment having the first portion and the second portion, respectively, wherein the first segment and the second segment are rotated about an axis that is perpendicular in relation to the longitudinal direction by 180°. Both of the segments may for example be designed as essentially rectangular frames, wherein several parallel equidistant ribs are formed on two opposing inner surfaces of each frame. In the example as shown, the segment bodies 24 and 24' of the segments 12 and 12', respectively, comprise an essentially rectangular cross section. The arrangement of the second segment 12' as shown in FIG. 8 results from the arrangement in the first segment 12 by rotating the segment 12 by 180° about an axis 30 that is perpendicular with respect to the main flow direction.

Figure 10:
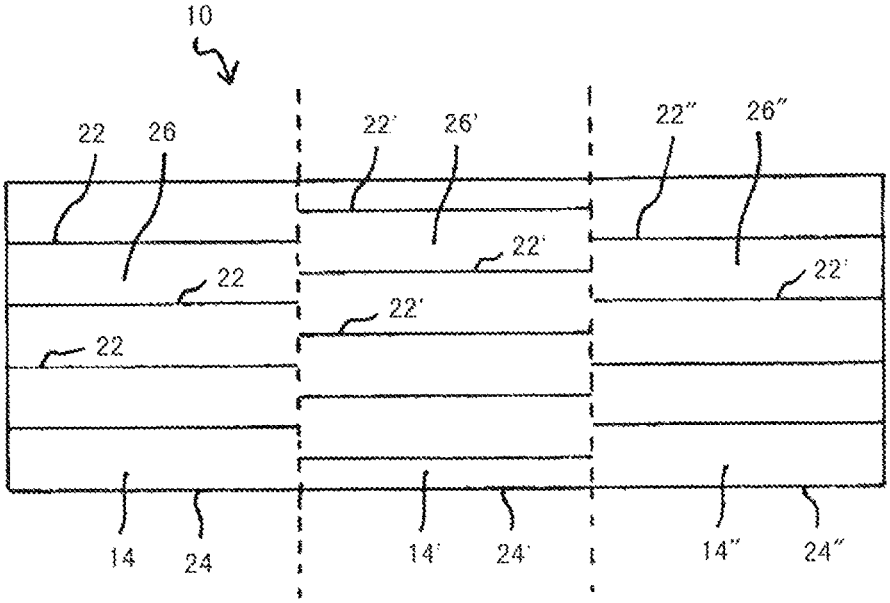
FIG. 10 shows a schematical view of an inner shell having three portions.

FIG. 10 schematically shows an example of an embodiment in which the inner shell of the heat dissipating body comprises at least three consecutive portions, for example a first portion having ribs 22, a subsequent second portion having ribs 22' and a third portion consecutive to the second portion having ribs 22'. The design options and advantages described in this disclosure with respect to the combination of the first and the second portions may be correspondingly transferred on the combination of the second and the third portions. The third portion may, for example, be a repetition of the first portion, i.e. it can be geometrically similar to the first portion. From a geometrical view, the third portion may be transferrable into the first portion by a translation in the longitudinal direction. In the example as shown, each rib 22 of the first portion and each rib 22" of the third portion are transversally displaced in relation to each rib 22' of the second portion. However, each rib 22 of the first portion is aligned with each rib 22" of the third portion.

The inner shell may comprise an alternating sequence of N portions. The number N of portions may for example be 3, 4, 5, 6 or more. The portions may be numbered 1 to N. The sequence may be alternating in this sense that each portion having the number I+2 (I=1 to N−2) is transferrable in the portion having the number I, by using a geometrical, i.e. an abstract or hypothetic, translation parallel to the longitudinal direction. Such an embodiment results in a high heat exchange rate. Each portion may be realized by a module or segment, making an efficient manufacturing possible.

Figure 11:
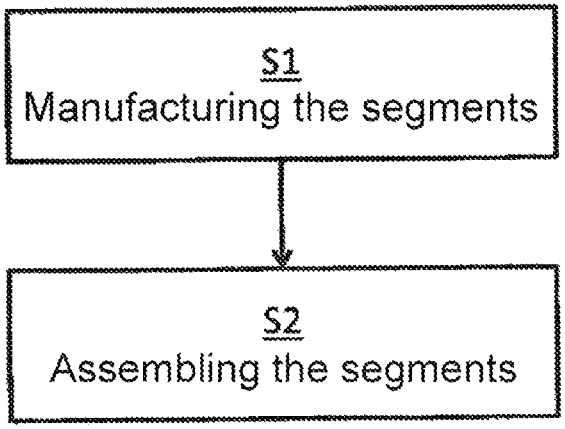
FIG. 11 shows a flow chart of a method of manufacturing a heat exchanger.

An example of a manufacturing method is illustrated by the flow chart in FIG. 11. In a first step S1 single segments are manufactured. Preferably, at least two segments are identical in order to minimize the costs of the manufacturing process. In a subsequent step S2, the segments are assembled, such that the single cavities of the segments merge into a single continuous cavity. Preferably, the segments are directly welded to each other, i.e. without the use of intermediate elements and, particularly, without the use of sealings. In doing so, directly consecutive segments are arranged such that the ribs of the following segment are transversally displaced in relation to the ribs of the preceding segment.

The top view in FIG. 2 schematically shows an example of an embodiment in which each rib 22 of the first portion 20 completely or in part covers a channel 26' of the second portion. Hence, the face surface of the rib 22 that faces the second portion 20' completely covers the transversal cross section of the channel 26' at the beginning or at the end of the channel facing the first portion 20. In other words, the cross section of the channel 26' at the beginning or at the end of the channel facing the first portion 20 is projected completely on the face surface of the rib 22 facing the second portion 20'.

In the example, the face surface of a rib 22 of the first portion 20 facing the second portion 20' is greater than the cross section of the channel 26' covered from this rib 22 at its beginning or end of the channel facing the first portion 20. The face surface of the rib 22 facing the second portion 20' completely overlaps the cross section of the channel 26' at its beginning or its end of the channel facing the first portion 20, while the cross section of the channel 26' at its beginning or its end of the channel facing the first portion 20' only partly overlaps the face surface of the rib 22 facing the second portion 20'.

In an alternative (not shown) of this example, a channel 26' of the second portion 20' and a rib 22 of the first portion 20 completely overlap each other transversally. Hence, the face surface of the rib 22 facing the second portion 20' completely overlaps the cross section of the channel 26' at its beginning or its end of the channel facing the first portion 20, and the cross section of the channel 26' also completely overlaps at its beginning or its end of the channel facing the first portion 20 the face surface of the rib 22 facing the second portion 20'. Hereby a good heat exchange is achievable using an amount of material for the ribs as small as possible.

Figure 12:
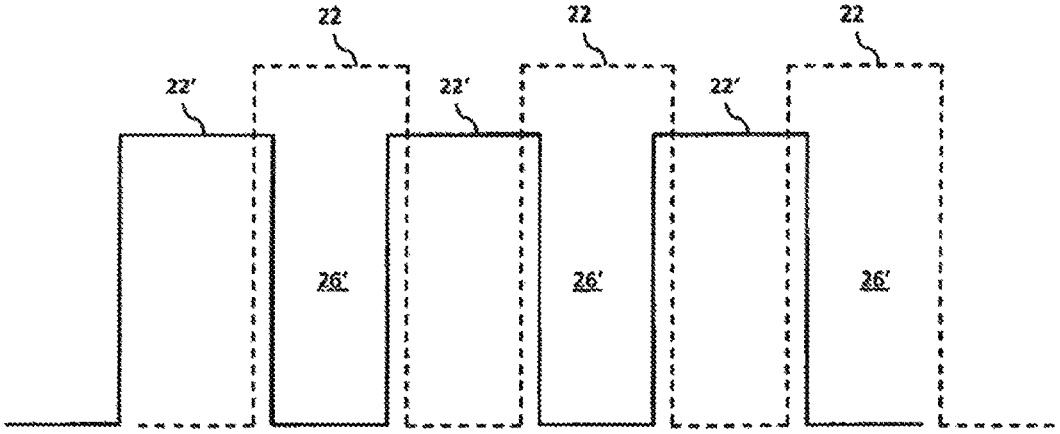
FIG. 12 shows a schematical top view of two segments according to a further embodiment.

Further, in the example according to FIG. 12, at least one of the ribs 22 of the first portion 20 is higher than each of the ribs 22 of the consecutive second portion 20'. The height of a rib is its transversal dimension, starting from the internal conduct 32, i.e. from the base of the rib. In other words, in this example at least one of the ribs 22 of the first portion 20 further extends into the cavity 14 in a transversal direction (compare FIG. 1) than the ribs 22' of the consecutive second portion 20'. If a concentrical design of the heat dissipating body is provided, as for example in the embodiment according to FIG. 7, the height of a rib can be defined as its radial dimension. If higher ribs are provided, a higher heat flow may be achieved. A larger height of the rib on the first portion 20 can be of particular advantage, if the first portion is upstream in relation to the second portion as for example in FIG. 1, since in this case the gas is expected to be warmer on the first portion than on the second portion. For example, the first portion 20 may comprise at least one rib 22 that is at least 10%, at least 20%, at least 50% or even at least 100% higher than the rib 22' of the second portion 20'.

The ribs 22 and 22', respectively, of each portion are closely packed according to the example of FIG. 12. For example, the distances of adjacent ribs of a portion are small as compared to a dimension or thickness of the rib measured transversal with respect to the longitudinal direction. Alternatively or additionally, at least at one or even at each point of the first and/or the second portion, the combined cross section of all ribs defined at this point, is larger than the combined cross section of the channels formed between the ribs. The combined cross section of the ribs and the channels, respectively, is the sum of the cross sections of the single ribs and channels, respectively, at the respective point, i.e. in the respective transversal plane.

The features explained with reference to FIG. 12 may be transferred in an analog manner to each of the embodiments according to FIGS. 1 to 10. For example, in the case of a concentrical design according to FIG. 7, it can be advantageous for the generation of turbulences that the ribs 22 of the first portion 20 have a greater height, i.e. a greater radial dimension, than the ribs 22' of the second portion 20'. In this case, the distance from the rotational symmetry axis 16 to a rib 22 of the first portion is smaller than the distance from the rotational symmetry axis 16' to a rib 22'.

In each of the embodiments described herein, the ribs extend in a transversal direction within the cavity 14, 14', however, not necessarily to an opposing surface of the cavity. In other words, it may be provided that at least one or even each of the ribs 22 and 22', respectively, protrude into the cavity 14, 14' in a transversal direction, without meeting another solid structural element. Therefore, each of the ribs has only one contiguous surface, and not several of them, that is circulated around by the fluid. The ribs can therefore be referred to as fins. In particular, it may be provided that the whole cavity 14, 14' is a contiguous spatial area. Thereby, a forming of turbulence patterns covering a relatively large space and of a good heat transport within the flowing fluid is allowed.

The features of the invention as disclosed in the preceding description, in the drawings and in the claims may be essential for realizing the invention, as well in single appearance as well as in any combination. "Several" means "at least two". For each feature as explained with respect to a single rib 22 or 22', it is contemplated that it may be advantageous that more or the most or all of the ribs 22, 22', respectively, may comprise the features of interest. Further, with respect to each feature explained with reference to a single channel 26 or 26', it may be advantageous that more or the most or all of the channels 26 and 26', respectively, comprise the feature of interest.

REFERENCE NUMERAL LIST

12 first segment
12' second segment
14 cavity
14' cavity
16 rotational symmetry axis
16' rotational symmetry axis
22 rib
22' rib
20 first portion
20' second portion
24 segment body
24' segment body
26 channel
26' channel
30 axis
32 internal conduct
34 end piece
36 longitudinal direction
38 internal space
40 combustion area
42 orifice
44 bottom surface
46 bottom area
48 outer shell

The invention claimed is:

1. A heat exchanger comprising:

an internal conduit for conducting a fluid; and a heat dissipating body for dissipating heat of the fluid, wherein the heat dissipating body includes a cavity extending in a longitudinal direction defined by the heat dissipating body, at least one end piece of the internal conduit extending inside of the cavity, the end piece having an orifice facing a bottom surface of the cavity, for feeding the fluid into a bottom area of the cavity;

a streaming space extending in the longitudinal direction between an outer shell of the internal conduit and an inner shell of the heat dissipating body, said streaming space conducting the fluid away from the bottom surface;

a first portion of the inner shell of the heat dissipating body including at least two ribs transversally displaced in relation to each other; and a second portion of the inner shell of the heat dissipating body adjacent to the first portion, said second portion including at least two ribs transversally displaced in relation to each other, at least one rib of the second portion being transversally displaced in relation to each rib of the first portion or at least one rib of the first portion being transversally displaced in relation to each rib of the second portion, wherein the heat dissipating body comprises:

a cast or extruded first segment including the first portion, and a cast or extruded second segment including the second portion.

2. The heat exchanger according to claim 1, in which the first segment and the second segment are substantially identical.

3. The heat exchanger according to claim 1, wherein each rib of the first portion extends to a channel located between two adjacent ribs of the second portion.

4. The heat exchanger according to claim 1, including a channel located between any two adjacent ribs of the first portion, the channel extending to one rib of the second portion.

5. The heat exchanger according to claim 1, in which the heat dissipating body or at least the inner shell of the heat dissipating body defines a rotational symmetry axis.

6. The heat exchanger according to claim 5, wherein the first and the second portions each include N ribs, and wherein the position of an $i^{th}$ rib of the first portion includes an azimuthal angle of $360°/N*i$, wherein $i=0, \ldots, N-1$, and the position of each $j^{th}$ rib of the second portion includes an azimuthal angle of $360°/N*(j+\alpha)$, wherein $j=0, \ldots, N-1$, and wherein a constant $\alpha$ has a value between 0 and ½.

7. The heat exchanger according to claim 1, wherein the ribs of the first portion and the ribs of the second portion are elongate extending in the longitudinal direction.

8. The heat exchanger according to claim 1, wherein the ribs of the first portion and the ribs of the second portion each extend over the whole of the respective portion in the longitudinal direction.

9. The heat exchanger according to claim 1, wherein the conduit is a pipe comprising a combustion chamber or a pipe in fluid communication with a combustion chamber.

10. The heat exchanger according to claim 1, wherein the inner shell of the heat dissipating body further includes a third portion adjacent to the second portion, the third portion having at least two ribs transversally displaced in relation to each other, wherein at least one rib of the third portion is transversally displaced in relation to each rib of the second portion, or wherein at least one rib of the second portion is transversally displaced in relation to each rib of the third portion.

* * * * *